US005469579A

United States Patent [19]

Tremblay et al.

[11] Patent Number: 5,469,579

[45] Date of Patent: Nov. 28, 1995

[54] HEAD COOLING DEVICE

[76] Inventors: Ronaldo Tremblay, 48, rue St-Henri, Cap de la Madeleine, Québec, Canada, G8T 7S6; Guy Tremblay, 227 rue Aubuchon, Cap de la Madeleine, Québec, Canada, G8T 8H4

[21] Appl. No.: 185,387

[22] Filed: Jan. 24, 1994

[30] Foreign Application Priority Data

Jan. 27, 1993 [GB] United Kingdom ..... 9301613
Mar. 30, 1993 [GB] United Kingdom ..... 9306607

[51] Int. Cl.[6] ..... A42B 3/28

[52] U.S. Cl. ..... 2/7; 2/171.2; 2/416; 607/110

[58] Field of Search ..... 2/7, 171.2, 209.13, 2/209.14, 411, 416, 422, 8, 175.1, 181, 181.6, 182.1, 182.3, 182.8, 413, 195.1; 62/259.3; 607/109, 110

[56] References Cited

U.S. PATENT DOCUMENTS

| | | | |
|---|---|---|---|
| 770,031 | 9/1904 | Werrick | 607/110 |
| 2,335,630 | 11/1943 | Bachardy | 2/7 |
| 3,070,803 | 1/1963 | Slepicka | 2/7 |
| 3,090,045 | 5/1963 | Hurst | 607/110 |
| 4,172,294 | 10/1979 | Harris | 2/416 |
| 4,551,858 | 11/1985 | Pasternack . | |
| 5,054,122 | 10/1991 | Sher | 2/7 |
| 5,197,292 | 3/1993 | McPherson | 2/7 |

*Primary Examiner*—Clifford D. Crowder
*Assistant Examiner*—Diana L. Biefeld
*Attorney, Agent, or Firm*—Pierre LesPérance; François Martineau

[57] ABSTRACT

A head cooling device for mounting over a person's head, generally within a headgear or a safety helmet. The device comprises: a housing, defining a main body enclosing a generally closed pocket, for containing ice cubes therein, a mouth, at one end of the main body, and an intermediate flooring, for supporting the ice cubes inside the pocket spacedly from the mouth. Thus, the flooring remains spaced at all times from the scalp by a spacing gap. The flooring is bored at its periphery, for enabling water droplets from the melting ice cubes to escape one at a time from the pocket, freely through the spacing gap and toward and against the person's head scalp. Flexible bands are used, integral to the housing, for releasably anchoring the housing to the head in generally overhanging fashion.

6 Claims, 3 Drawing Sheets

HEAD COOLING DEVICE

FIELD OF THE INVENTION

This invention relates to devices for refreshing persons in hot weather, particularly for field use by sportsmen, and also by persons in hot climates.

BACKGROUND OF THE INVENTION

Under searing heat conditions, people are prone to sunstrokes, i.e. to suffer from an incapacitating health condition attributable to intense heat and sunray levels. Even if sunstroke is not reached, various intermediate conditions can be observed: loss of concentration, irritability, decreased physical performance output (for sportsmen), and generally speaking, a certain level of discomfort. This situation is compounded by the fact that the hat a person wears, which is effective in shielding the head from sun burns, may on the other hand generate increased perspiration and thus incomfort, leading undesirably to its removal by that person.

The existing cold-storing devices, such as the so-called ice-packs, are useful in keeping foodstuff cool. But when it comes to applying those devices against a person's body, the direct or indirect contact generates a thermal shock which may freeze the corresponding skin portion of this person. Accordingly, by trying to shield the person from extreme heat, we impose upon him exactly the inverse situation, namely, submitting him to extreme cold at a localized area—an unsatisfactory solution.

A typical illustration of such prior art devices is disclosed in U.S. Pat. No. 3,090,045 issued May 21, 1963 to Mr. Howard Lee HURST. In this patent, a flexible bag 1 is to be mounted either inside (FIG. 1) or in overhanging fashion over (FIG. 6) a conventional cap or hat 18. Bag 1 encloses a plurality of ice cubes 14. It is understood that in the embodiment of FIG. 1, the bag 1 abuts directly against the scalp of the person; while in the embodiment of FIG. 6, the fabric of the hat 18 is sandwiched between the bag 1 and the head of the person. However, in both cases, head cooling is achieved thanks to thermal conduction, i.e. transfer of cold by direct or indirect contact with the head. We have already explained why such an arrangement is unsatisfactory: a thermal shock may occur because of the conductive nature of the thermal transfer.

Another example of prior art head cooling devices includes the one disclosed in U.S. Pat. No. 5,054,122 issued Oct. 8, 1991 to the Taiwanese Cheng-Hsien SHER. A conical hat 1 is provided, with an annular channel member 10 installed at an intermediate portion thereof. This channel member 10 supports cooling elements 2 (heat absorbing chemicals). The cold air thus released by the cooling elements is allowed to circulate inside the hat through a plurality of vent holes 31, made on an inner ventilation socket 3, to cool the head. In this case, head cooling operates under convection forces, i.e. via the air circulation induced by variation in air density associated with a thermal gradient. Clearly, and as is apparent from FIG. 6, the inner ventilation socket substantially engage directly against the head, so that only a small area of the head will be immediately cooled, the remainder of the head (and of the person's body) being cooled through endogenous (vascular) thermoregulation. Obviously, such an arrangement cannot be adapted to safety helmets, farmer's hats, or the like. The cold-releasing chemical agents 2 inside the channel member 10 could possibly pose a safety threat, should they accidentally leak from their cells and come in direct engagement with the head (the head being the most fragile part of the body, which is why through the million years of human evolution, the head has moved farthest away from the dangerous ground level). Finally, some conduction-type thermal transfer cannot be excluded, since the layers 10, 2 and 3 are in direct engagement with one another, so that the scalp may again be undesirably subjected to a thus induced thermal shock via indirect engagement with the cold releasing cells 2.

OBJECTS OF THE INVENTION

The gist of the present invention is therefore to address the cooling needs of persons, particularly in warm to hot indoor or outdoor environments, at a very low cost.

A general object of the invention is to provide such a head cooling device, which is substantially inconspicuous (being concealed within a head gear or safety helmet) while remaining fully effective.

An alternate object of the invention is to provide a device for alleviating headaches.

An object of this invention is to provide a head cooling device that is adaptable to—i.e. compatible with—any existing conventional headgear, without modification to the headgear.

SUMMARY OF THE INVENTION

In accordance with the objects of the invention, there is disclosed a head cooling device for mounting over a person's head, comprising: (a) a housing member defining a main body enclosing a generally closed pocket, for containing ice cubes therein, a mouth, at one end of said main body, and a flooring member, for supporting the ice cubes inside said pocket, said flooring member being offset into said pocket spacedly from said mouth whereby said flooring member is to remain spaced at all times from the scalp of the head by a spacing gap; (b) percolation means, for enabling water droplets from the melting ice cubes to escape from said pocket, freely through said spacing gap and toward and against the person's scalp; and (c) means for use with a head gear in releasably anchoring said housing member to said head in generally overhanging fashion.

Preferably, said percolation means includes a number of spaced through-bores, made into said flooring member. Said flooring member could then include a main, generally domed-shaped portion oriented toward and into said pocket, and a peripheral annular step, destined to extend within a generally horizontal plane; and said percolation means including a number of spaced through-bores, made into said peripheral step, whereby the slope of said domed-shape portion promotes circulation of melted water from the ice cubes toward said through-bores under gravity-borne forces.

Advantageously, said flooring member is detachable from the housing member main body, and further including anchoring means, for releasably anchoring said flooring member to said main body. Said housing main body could then include an annular wall defining an open mouth, and said flooring member is generally discoid and defines a peripheral circular edge portion, and wherein said anchoring means includes a flange transversely carried by said flooring member circular edge portion, said flange being conical and being sized for friction fit interlocking engagement with the interior face of said housing open mouth.

Profitably, said housing member main body further includes an integral cover, opposite said mouth thereof, and said flooring member further includes an annular lip, radially outwardly extending from said conical flange thereof, said lip and mouth being in register with one another whereby collapse of said flooring member against said cover is prevented.

It is envisioned that said head anchoring means includes at least a few resilient strips, integrally carried by and laterally outwardly extending from said housing mouth, and means for biasing said strips against the person's head to conformingly fit therearound. Then, said biasing means could either consist in the fitting of a helmet or hat over said housing member and surroundingly against said straps; or in a resilient head band, integrally joining the outer ends of said straps and sized to fit around the person's head.

DETAILED DESCRIPTION OF THE DRAWINGS

Figure 5:
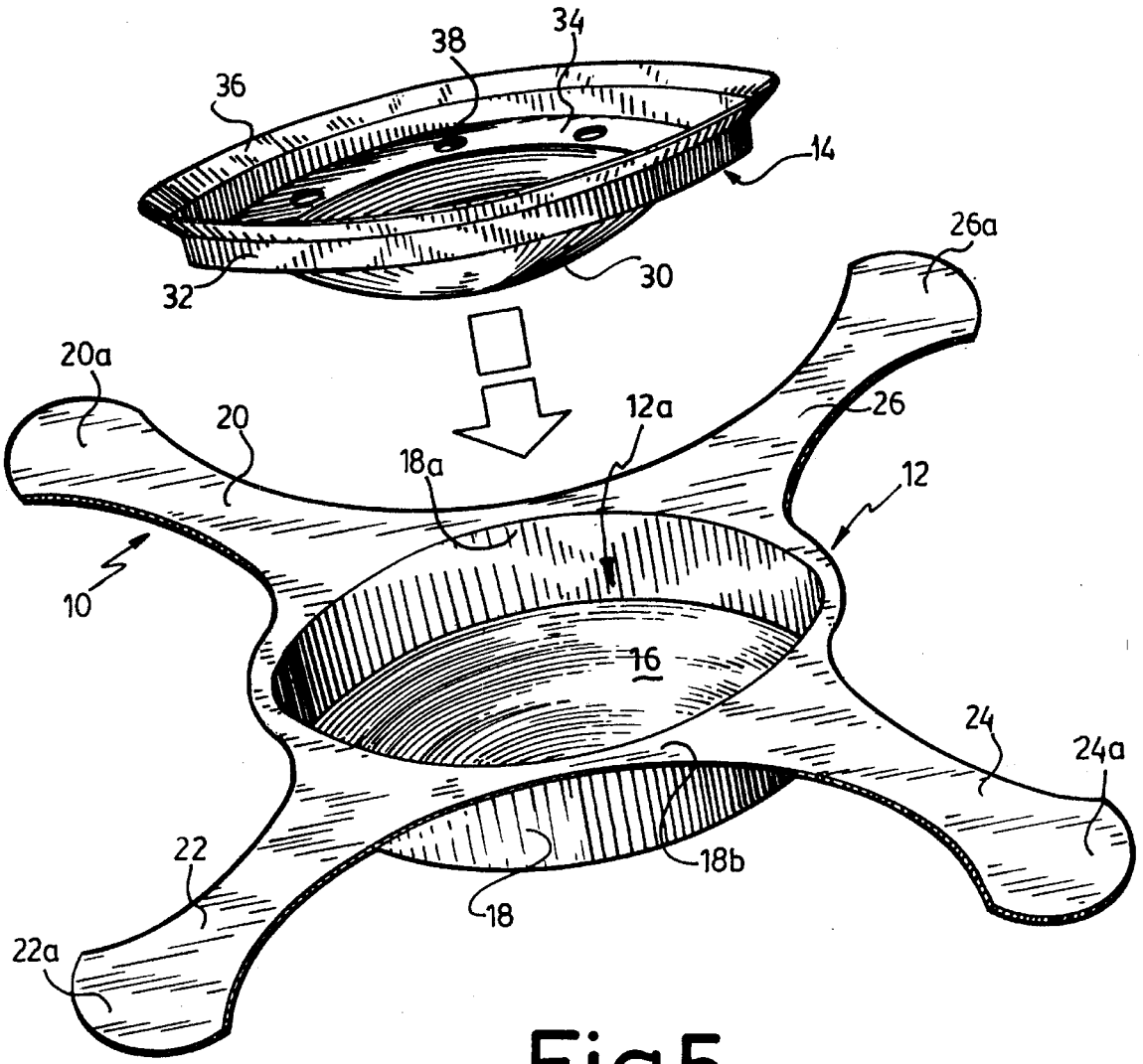
FIG. 5 is an exploded, isometric view of the head cooling device, with the ice cubes being removed.
Figure 6:
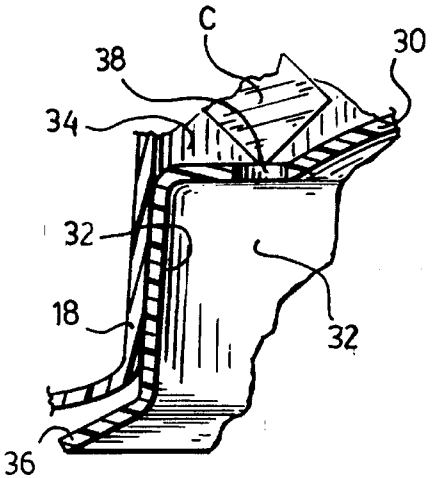
FIG. 6 is a view at an enlarged scale taken about the area circumscribed by arrow 6 in FIG. 3, showing one water droplet outlet port in the flooring member.

The head cooling device 10 is shown in FIG. 5 to consist essentially of two detachable parts 12 and 14. Part 12 forms a cup member, defining a discoid, arcuate, main flat wall 16 and an annular side wall 18 integrally carried edgewisely of the discoid wall 16. A number of flat elongated legs, e.g. four legs 20, 22, 24 and 26 project radially outwardly from the free circular edge 18*a* of the annular side wall 18. Legs 20–26 are resiliently flexible bands for tilting motion through the plane intersecting the free circular side wall edge 18*a*. Legs 20–26 are to be used as head-securing means for centrally positioning and maintaining the cup member 12 over the head H of a person P, with the circular edge 18*a* abutting against the head H. As suggested in FIG. 1, this securing action can be achieved by biasing the legs 20–26 to conformingly fit inside the crown of any conventional hat or helmet E, or similar headgear, and by thereafter positioning such headgear over a person's head, the legs 20–26 are therefore biased against the sides of the head to secure by friction fit parts 12 and 14 within the hat. Alternately, as suggested in FIG. 2, the four enlarged free end portions 20*a*–26*a* of legs 20–26 may be integrally interconnected to one another by an annular strip 28, said strip 28 forming a semi-rigid head-band and being sized to snugly fit around the upper portion of the head H so as to support the cup member 12 over the head H. Cup member 12 forms an inner well 12*a* destined to receive and contain a number of ice cubes C.

Part 14 includes a dome section 30, merging with an annular conical section 32 via an annular step 34; a radially outturned lip 36 being provided along the diametral edge of conical section 32 opposite step 34. Step 34 includes a number of spaced through-bores 38. Part 14 is sized to allow engagement of dome part 30—but not lip 36—into the well 12*a* formed by cup member 12. Moreover, the diameter of conical section 32 is sized to enable progressive friction fit interlock with the free edge portion 18*a* of the cup member annular wall 18, so that the dome section 30 be fixedly positioned within the well 12*a* of the cup member, spacedly from the (preferably convex) floor 16 of the cup member 12. Lip 36, by eventually abutting (at its external surface) against a radially outturned flange extension 18*b* of the annular wall edge 18*a*, limits the insertion of the dome part 30 inside the well 12*a*, to prevent dome part 30 from coming in direct contact with correspondingly arcuately shaped flooring 16. (Flange 18*b* merges with legs 20–26) Hence, this remaining (generally closed) pocket 40 between dome wall 30 and flooring 16 defines the effective area for loading and containing the ice cubes C.

It can now be understood that, in a warm environment, as the ice cubes C progressively melt inside pocket 40, the thus formed water droplets will escape from pocket 40 under gravity borne forces, by percolating through the through-bores 38 of annular step 34, toward and against the head H and the neck of the person, whereby this person will be refreshed. The water droplets will fall one by one, in a discontinuous fashion, for example at a frequency of about one droplet each ten seconds. The pocket 40 should preferably be so sized that the ice cubes C inside this pocket 40 could last for example between 1.5 to 2.5 hours, depending on whether the head cooling device 10 is used in direct sunlight conditions or under shade.

Figure 3:
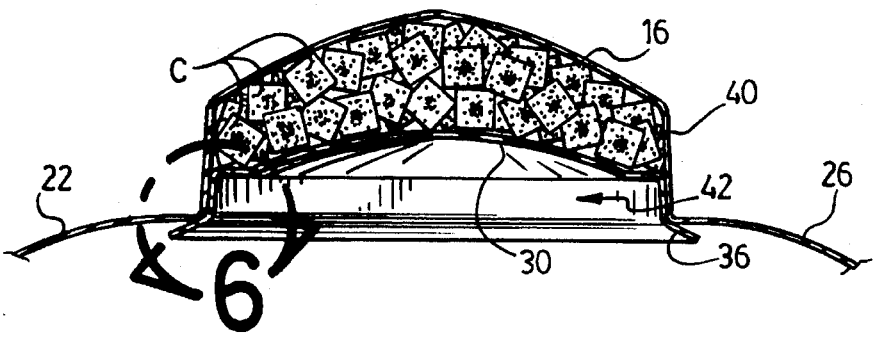
FIG. 3 is an enlarged cross-sectional view taken along line 3—3 of FIG. 2, showing the ice cubes inside the containing pocket.
Figure 4:
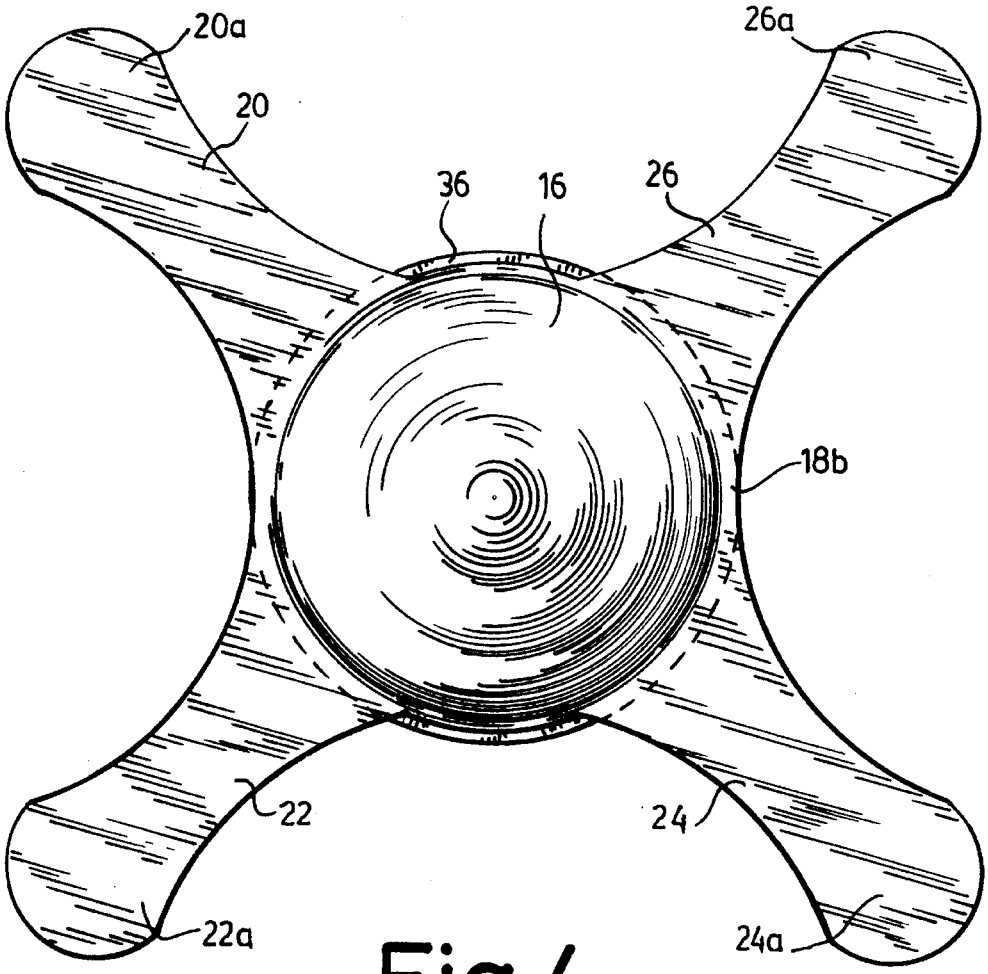
FIG. 4 is a top plan view of the head cooling device.

As clearly illustrated in FIG. 3, an important comfort-enhancing feature of the present invention is the gap 42 remaining between the percolation wall 30, 34 and the radially outturned lip 36. This gap 42 ensures that, upon fitting the head cooling device 10 over the head H, the percolation wall 30, 34, will not come in direct engagement with the head H; otherwise, the ice inside pocket 40 and abutting by their own weight against dome part 30 would brutally transfer subfreezing temperatures to the scalp by conduction through the dome part 30, particularly in the case of bald persons or infants, leading possibly to undesirably freezing said scalp. Thus, for the comfort of the wearer, it is important that the ice C does not come into direct conductive (via wall 30) contact with the head scalp.

It is understood that, by installing a helmet, a hat or the like over the head cooling device 10, not only is the device 10 secured in position by the annular strap of the helmet or hat, but also, the device 10 becomes generally concealed from exterior view. This may constitute an advantage for those that are sensitive to being least conspicuous possible. Hat E may be for sports, tourism, for the military, or for workers in the industry— bakeries, mines, construction, . . . , or also for use as a night hat. The hat E may even be replaced by the top part of a costume, e.g. being fitted into the ears of a "bunny" figure costume.

The head cooling device will preferably be manufactured from a plastic material, via the well known process of thermoforming under vacuum. The shaped plastic parts 12 and 14 will then be cut with a die-cutter into a roller die cutting machine. Finally, the percolating bores 38 will then be made with a press machine of the punch and die type.

The head cooling device of the invention will accordingly be lightweight, of a very low manufacturing cost, and very easy in use. A suitable plastic material is preferred; however, fabric, metallic alloy, fiberglass, aluminum, rubber and other suitable materials are not excluded from the scope of the present invention; provided the selected structural material is substantially non conductive, to prevent undesirable thermal transfer by conduction to the scalp. Clearly, the ice cubes, which are preferred because of their low cost, could be replaced by alternate equivalents, e.g. a closed-cycle freon-based apparatus (similar to those used in refrigerators), or the more recent acoustically-based cold generating devices (where a sound wave that is produced at a defined frequency and intensity generates air compression ($\Delta V$) which can be translated into a thermal variation ($\Delta T$)

$$PV=nRT$$

Figure 1:
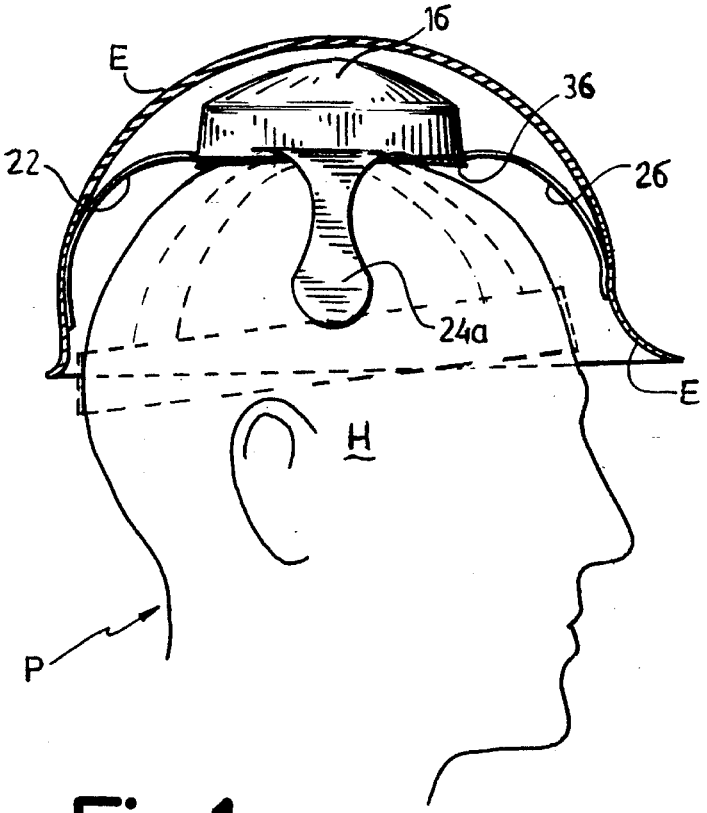
FIG. 1 is a side elevation of the silhouette of a person's head, being fitted with a preferred embodiment of the head cooling device, the latter shown in cross-section.
Figure 2:
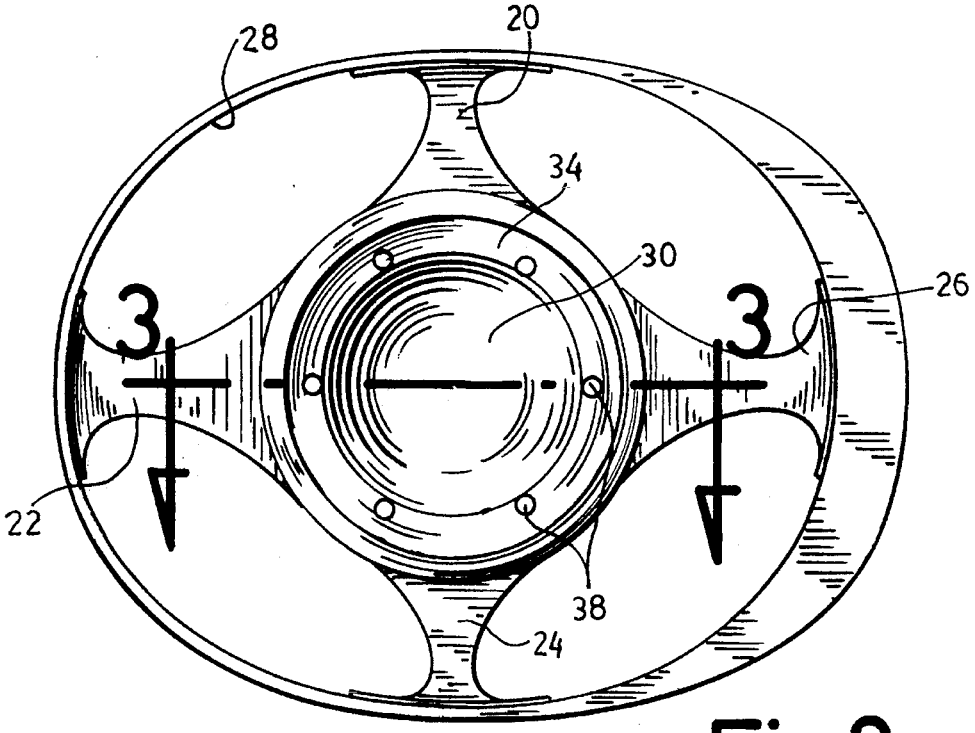
FIG. 2 is a bottom plan view of the head cooling device.

In FIG. 1, although the cover 16 of the cup member 12 is shown to abut directly against the rigid shell of helmet E, it is understood that, alternately and preferably, a gap will remain therebetween, so as to prevent device 10 from transmitting to the head H the impact from a blow sustained by the helmet.

As illustrated in FIG. 1, it is understood that it is lip 36 from the percolation wall 30–36 that directly engages the scalp of head H, not the mouth flange **18*b* of cup member 12**. What we therefore achieve is a permanent delicate shower of water droplets, falling over the head for one to three hours, during which period the wearer will be continuously refreshed without being threatened of a conduction-borne freeze shock about the wearer's skin.

I claim:

1. A head cooling device for mounting over a person's head, comprising:

(a) a housing member, defining a main body enclosing a generally closed pocket, for containing ice cubes therein, a mouth, at one end of said main body, and an intermediate flooring member, for supporting the ice cubes inside said pocket, said flooring member being offset into said pocket spacedly from said mouth, whereby in operation, said flooring member remains spaced at all times from the scalp of the head by a spacing gap;

(b) percolating means, including a number of spaced through-bores, made into said flooring member, for enabling water droplets from the melting ice cubes to escape in a discontinuous fashion from said pocket, freely through said flooring member and spacing gap and toward and against the person's scalp; and (c) means for use with a headgear in releasably anchoring said housing member to said head in generally overhanging fashion;

wherein said flooring member includes a main, generally domed-shaped portion oriented toward and into said pocket, and a peripheral annular step, destined to extend in operative, head covering condition within a generally horizontal plane; and said percolation means including a number of spaced through-bores, made into said peripheral step, whereby the slope of said domed-shape portion promotes circulation of melted water from the ice cubes toward said through-bores under gravity-borne forces.

2. A head cooling device as defined in claim 1, with said flooring member being detachable from the housing member main body, and further including attachment means, for releasably attaching said flooring member to said main body; said housing main body forming an annular wall, and said flooring member is generally discoid and defines a peripheral circular edge portion;

wherein said attachment means includes a flange transversely carried by said flooring member circular edge portion, said flange being conical and being sized for friction fit interlocking engagement with the interior face of said housing mouth.

3. A head cooling device as defined in claim 2, wherein said housing member main body further includes an integral cover, opposite said mouth thereof, and said flooring member further includes an annular lip, radially outwardly extending from said conical flange thereof, said lip and mouth being in register with one another whereby collapse of said flooring member against said flooring member is prevented.

4. A head cooling device as defined in claim 1, wherein said head anchoring means includes at least a few resilient bands, integrally carried by and laterally outwardly extending from said housing mouth.

5. A head cooling device as defined in claim 4, further including a semi-rigid head band, integrally joining the outer ends of said resilient bands and sized to fit around the person's head.

6. A head cooling device for mounting over a person's head, comprising:

(a) a housing member, defining a main body forming an annular wall and enclosing a generally closed pocket, for containing ice cubes therein, a mouth, at one end of said main body, and an intermediate generally discoid flooring member, for supporting the ice cubes inside said pocket, said flooring member being detachable from the housing member main body and defining a peripheral circular edge portion and being offset into said pocket spacedly from said mouth, whereby in operation, said flooring means remains spaced at all times from the scalp of the head by a spacing gap;

(b) percolation means, including a number of spaced through-bores, made into said flooring member, for enabling water droplets from the melting ice cubes to escape in a discontinuous fashion from said pocket, freely through said flooring member and spacing gap and toward and against the person's scalp;

(c) means for use with a headgear in releasably anchoring said housing member to said head in generally overhanging fashion; and (d) attachment means for releasably attaching said flooring member to said main body, including a flange transversely carried by said flooring member circular edge portion, said flange being conical and being sized for friction fit interlocking engagement with the interior face of said housing wherein said housing member main body further includes an integral cover, opposite said mouth thereof, and said flooring member further includes an annular lip, radially outwardly extending from said conical flange thereof, said lip and mouth being in register with one another whereby collapse of said flooring member against said cover is prevented.

* * * * *